US006688863B2

(12) United States Patent
Hoshino et al.

(10) Patent No.: US 6,688,863 B2
(45) Date of Patent: Feb. 10, 2004

(54) OIL LEAK PREVENTION STRUCTURE OF VACUUM PUMP

(75) Inventors: Nobuaki Hoshino, Kariya (JP); Masahiro Kawaguchi, Kariya (JP); Hiroyuki Ishigure, Kariya (JP); Shinya Yamamoto, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/184,843

(22) Filed: Jun. 28, 2002

(65) Prior Publication Data

US 2003/0003008 A1 Jan. 2, 2003

(30) Foreign Application Priority Data

Jun. 29, 2001 (JP) ..... 2001-198020

(51) Int. Cl.[7] ..... F04C 18/18; F04C 27/00

(52) U.S. Cl. ..... 418/104; 418/88; 418/206.6; 418/206.8

(58) Field of Search ..... 418/88, 104, 206.6, 418/206.8; 184/6.16

(56) References Cited

U.S. PATENT DOCUMENTS

| | | | | |
|---|---|---|---|---|
| RE25,567 E | * | 5/1964 | Lorenz | 418/88 |
| 4,990,069 A | * | 2/1991 | Guittet et al. | 418/104 |
| 5,338,167 A | * | 8/1994 | Berges | 418/104 |
| 5,836,753 A | | 11/1998 | Takei et al. | 418/95 |
| 5,908,195 A | | 6/1999 | Sharrer | 277/412 |
| 6,095,780 A | * | 8/2000 | Ernens | 418/104 |

FOREIGN PATENT DOCUMENTS

| | | | | |
|---|---|---|---|---|
| DE | 868 488 | | 2/1953 | |
| EP | 0 859 154 A1 | | 8/1998 | |
| FR | 1449257 | | 8/1966 | |
| GB | 1570266 | | 6/1980 | |
| JP | 61-291795 | * | 12/1986 | 418/104 |
| JP | 63-129829 | | 6/1988 | |
| JP | 03-011193 | | 1/1991 | |
| JP | 3-130592 | * | 6/1991 | 418/104 |
| JP | 7-158571 | | 6/1995 | |

* cited by examiner

*Primary Examiner*—John J. Vrablik
(74) *Attorney, Agent, or Firm*—Morgan & Finnegan, LLP

(57) ABSTRACT

A vacuum pump draws gas by operating a gas conveying body in a pump chamber through rotation of a rotary shaft. The vacuum pump has an oil housing member, a stopper and a circumferential wall surface. The oil housing member defines an oil zone adjacent to the pump chamber. The stopper has a circumferential surface. The stopper is located on the rotary shaft to rotate integrally with the rotary shaft and prevents oil from entering the pump chamber. The center of curvature of the circumferential wall surface coincides with that of the rotary shaft. The circumferential wall surface surrounds at least a part of the circumferential surface of the stopper that is above the rotary shaft. The circumferential wall surface is inclined such that the distance between the circumferential wall surface and the axis of the rotary shaft decreases toward the oil zone.

18 Claims, 10 Drawing Sheets

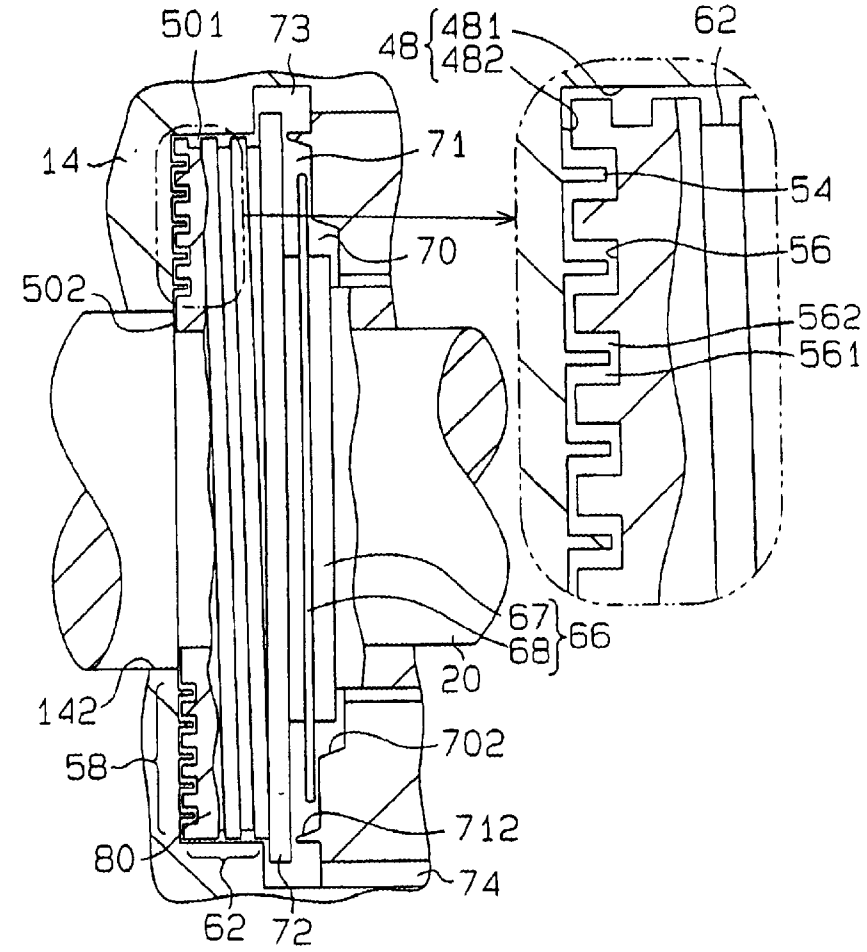
Fig. 5(c)
Fig. 5(b)
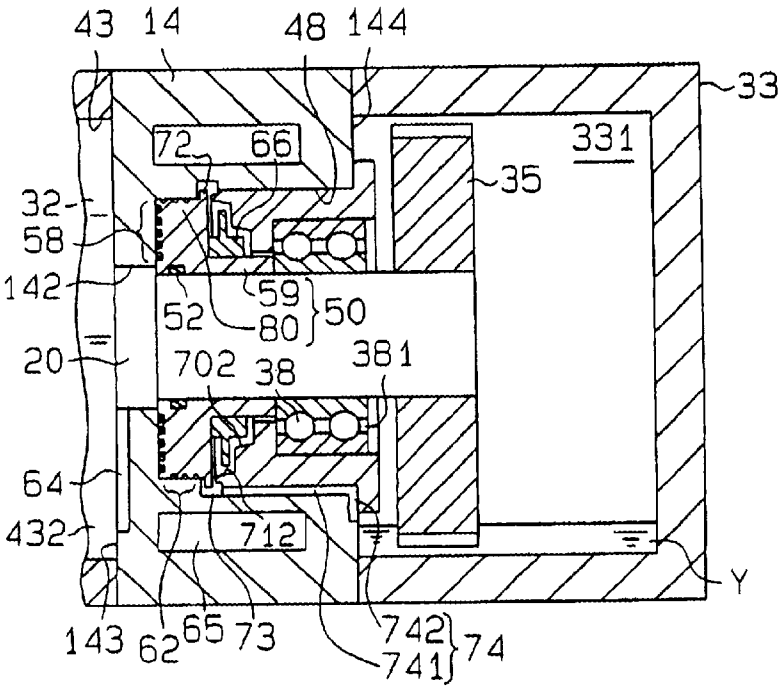
Fig. 5(a)

OIL LEAK PREVENTION STRUCTURE OF VACUUM PUMP

BACKGROUND OF THE INVENTION

The present invention relates to an oil leak prevention structure of vacuum pumps that draw gas by operating a gas conveying body in a pump chamber through rotation of a rotary shaft.

In a typical vacuum pump, lubricant oil is used for lubricating moving parts. Japanese Laid-Open Patent Publications No. 63-129829 and No. 3-11193 disclose vacuum pumps having structures for preventing oil from entering zones where presence of lubricant oil is undesirable.

In the vacuum pump disclosed in Publication No. 63-129829, a plate for preventing oil from entering a generator chamber is attached to a rotary shaft. Specifically, when moving along the surface of the rotary shaft toward the generator chamber, oil reaches the plate. The centrifugal force generated by rotation of the plate spatters the oil to an annular groove formed about the plate. The oil flows to the lower portion of the annular groove and is then drained to the outside along a drain passage connected to the lower portion.

The vacuum pump disclosed in Publication No. 3-11193 has an annular chamber for supplying oil to a bearing and a slinger provided in the annular chamber. When moving along the surface of a rotary shaft from the annular chamber to a vortex flow pump, oil is thrown away by the slinger. The thrown oil is then sent to a motor chamber through a drain hole connected to the annular chamber.

The plate (slinger), which rotates integrally with the rotary shaft, is a mechanism that prevents oil from entering undesirable zones. When centrifugal force generated by rotation of a plate (slinger) is used for preventing oil from entering a certain zone, the effectiveness is influenced by the shapes of the plate (slinger) and the walls surrounding the plate (slinger).

SUMMARY OF THE INVENTION

Accordingly, it is an objective of the present invention to provide an oil leak prevention mechanism that effectively prevents oil from entering a pump chamber of a vacuum pump.

To achieve the foregoing and other objectives and in accordance with the purpose of the present invention, the invention provides a vacuum pump. The vacuum pump draws gas by operating a gas conveying body in a pump chamber through rotation of a rotary shaft. The vacuum pump has an oil housing member, a stopper and a circumferential wall surface. The oil housing member defines an oil zone adjacent to the pump chamber. The rotary shaft has a projecting portion that projects from the pump chamber into the oil zone through the oil housing member. The stopper has a circumferential surface. The stopper is located on the rotary shaft to rotate integrally with the rotary shaft and prevents oil from entering the pump chamber. The center of curvature of the circumferential wall surface of coincides with that of the rotary shaft. The circumferential wall surface surrounds at least a part of the circumferential surface of the stopper that is above the rotary shaft. The circumferential wall surface is inclined such that the distance between the wall and the axis of the rotary shaft decreases toward the oil zone.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is an enlarged partial cross-sectional view of the pump shown in FIG. 1(*a*);

FIG. 2(*b*) is a cross-sectional view taken along line 2*b*—2*b* in FIG. 1(*a*);

FIG. 3(*b*) is a cross-sectional view taken along line 3*b*—3*b* in FIG. 1(*a*);

FIG. 4(*b*) is an enlarged partial cross-sectional view of the pump shown in FIG. 4(*a*); FIG. 4(*c*) is an enlarged partial cross-sectional view of the pump shown in FIG. 4(*b*);

FIG. 5(*a*) is a cross-sectional view taken along line 5*a*—5*a* in FIG. 3(*b*); FIG. 5(*b*) is an enlarged partial cross-sectional view of the pump shown in FIG. 5(*a*); FIG. 5(*c*) is an enlarged partial cross-sectional view of the pump shown in FIG. 5(b);

FIG. 6(*b*) is an enlarged partial cross-sectional view of the pump shown in FIG. 6(*a*);

DETAILED DESCRIPTION OF THE PREFERRED EMBODIMENTS

A multiple-stage Roots pump 11 according to a first embodiment of the present invention will now be described with reference to FIGS. 1(*a*) to 8.

Figure 1B:
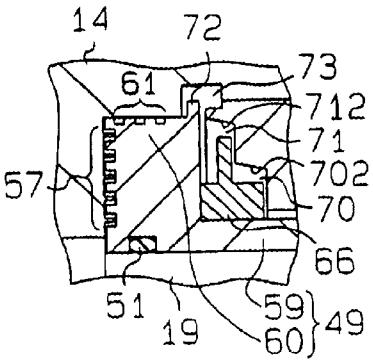
FIG. 1(*a*) is a cross-sectional plan view illustrating a multiple-stage Roots pump according to a first embodiment of the present invention.
Figure 1A:
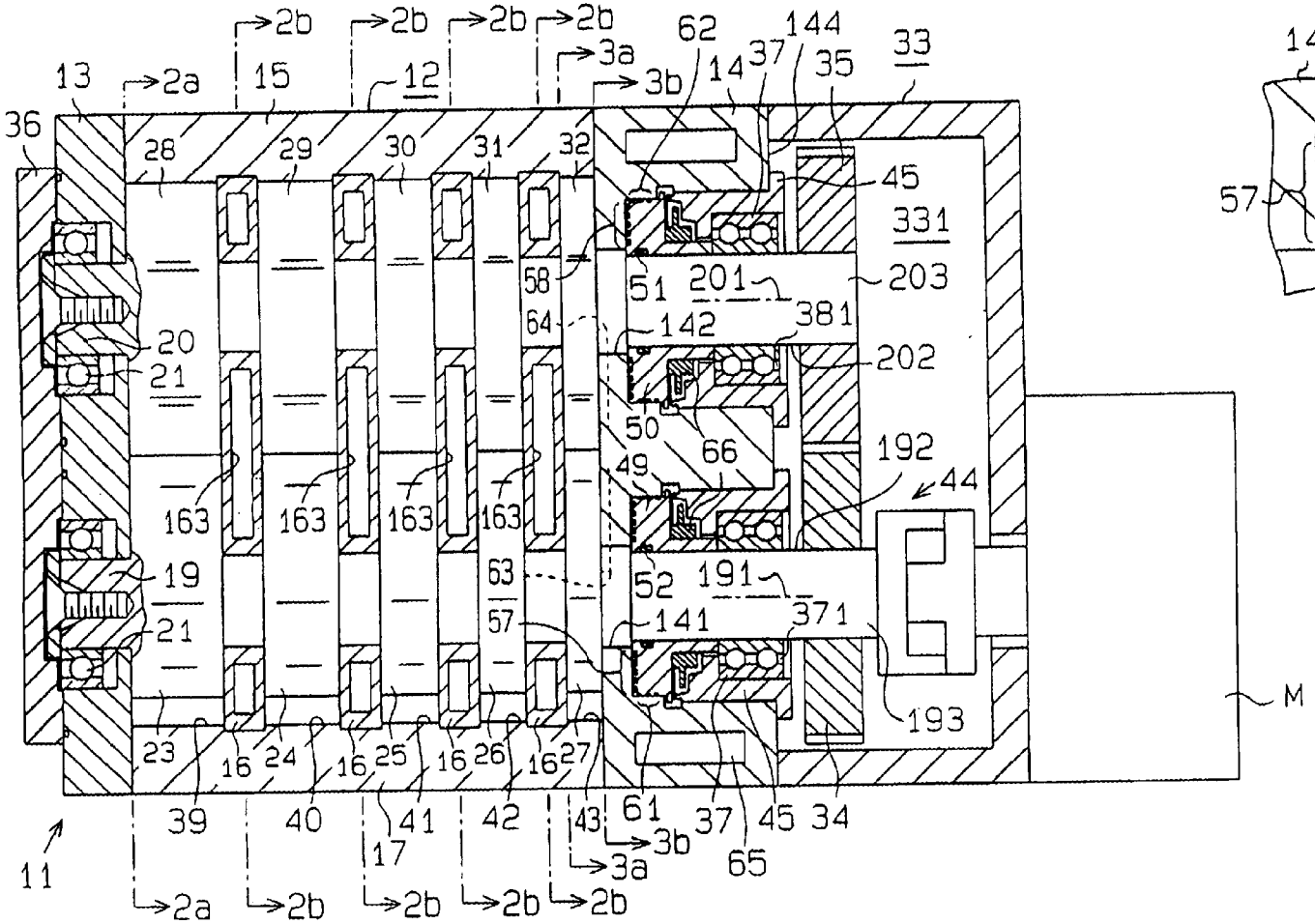
Figure 2A:
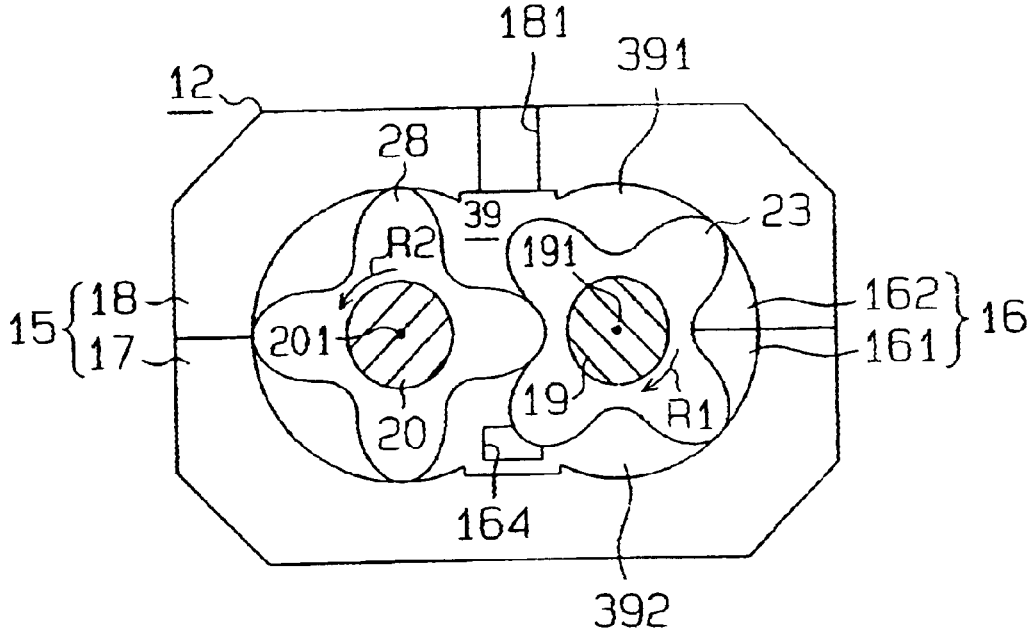
FIG. 2(*a*) is a cross-sectional view taken along line 2*a*—2*a* in FIG. 1(*a*)
Figure 2B:
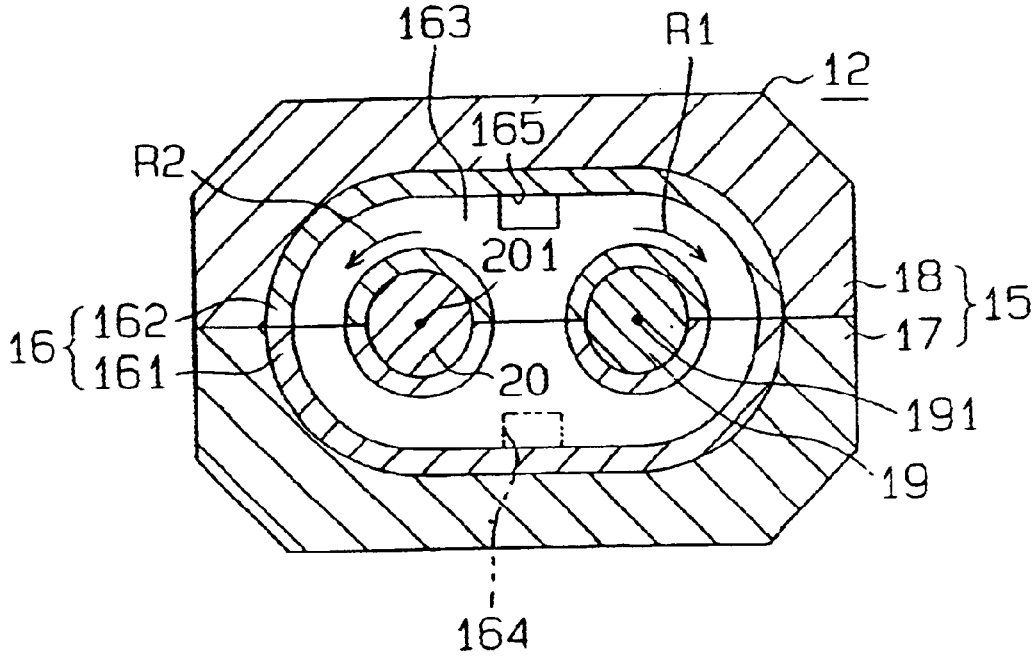

As shown in FIG. 1(*a*), the pump 11, which is a vacuum pump, includes a rotor housing member 12, a front housing member 13, and a rear housing member 14. The front housing member 13 is coupled to the front end of the rotor housing member 12. A lid 36 closes the front opening of the front housing member 13. The rear housing member 14 is coupled to the rear end of the rotor housing member 12. The rotor housing member 12 includes a cylinder block 15 and chamber defining walls 16, the number of which is four in this embodiment. As shown in FIG. 2(*b*), the cylinder block 15 includes a pair of blocks 17, 18. Each chamber defining wall 16 includes a pair of wall sections 161, 162. As shown in FIG. 1(*a*), a first pump chamber 39 is defined between the front housing member 13 and the leftmost chamber defining wall 16. Second, third, and fourth pump chambers 40, 41, 42 are each defined between two adjacent chamber defining walls 16 in this order from the left to the right as viewed in the drawing. A fifth pump chamber 43 is defined between the rear housing member 14 and the rightmost chamber defining wall 16.

A first rotary shaft 19 is rotatably supported by the front housing member 13 and the rear housing member 14 with a pair of radial bearings 21, 37. Likewise, a second rotary shaft 20 is rotatably supported by the front housing member 13 and the rear housing member 14 with a pair of radial bearings 21, 37. The first and second rotary shafts 19, 20 are parallel to each other. The rotary shafts 19, 20 extend through the chamber defining walls 16. The radial bearings 37 are supported by bearing holders 45. Two bearing receptacles 47, 48 are formed in end 144 of the rear housing member 14. The bearings holders 45 are fitted in the bearing receptacles 47, 48, respectively.

First, second, third, fourth, and fifth rotors 23, 24, 25, 26, 27 are formed integrally with the first rotary shaft 19. Likewise, first, second, third, fourth, and fifth rotors 28, 29, 30, 31, 32 are formed integrally with the second rotary shaft 20. As viewed in the direction along the axes 191, 201 of the rotary shafts 19, 20, the shapes and the sizes of the rotors 23–32 are identical. However, the axial dimensions of the first to fifth rotors 23–27 of the first rotary shaft 19 become gradually smaller in this order. Likewise, the axial dimensions of the first to fifth rotors 28–32 of the second rotary shaft 20 become gradually smaller in this order. The first rotors 23, 28 are accommodated in the first pump chamber 39 and are engaged with each other. The second rotors 24, 29 are accommodated in the second pump chamber 40 and are engaged with each other. The third rotors 25, 30 are accommodated in the third pump chamber 41 and are engaged with each other. The fourth rotors 26, 31 are accommodated in the fourth pump chamber 42 and are engaged with each other. The fifth rotors 27, 32 are accommodated in the fifth pump chamber 43 and are engaged with each other. The first to fifth pump chambers 39–43 are not lubricated. Thus, the rotors 23–32 are arranged not to contact any of the cylinder block 15, the chamber defining walls 16, the front housing member 13, and the rear housing member 14. Further, the rotors of each engaged pair do not slide against each other.

Figure 3A:
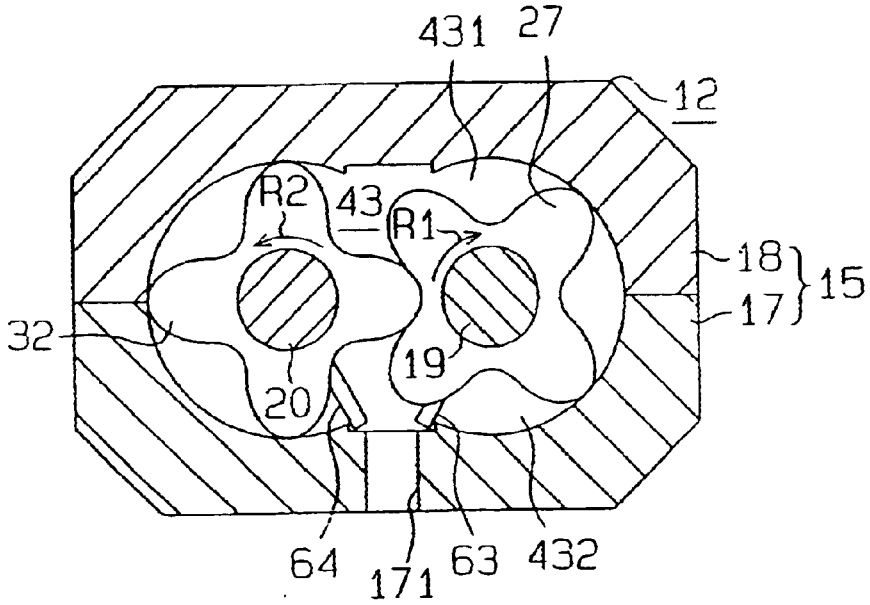
FIG. 3(*a*) is a cross-sectional view taken along line 3*a*—3*a* in FIG. 1(*a*)
Figure 3B:
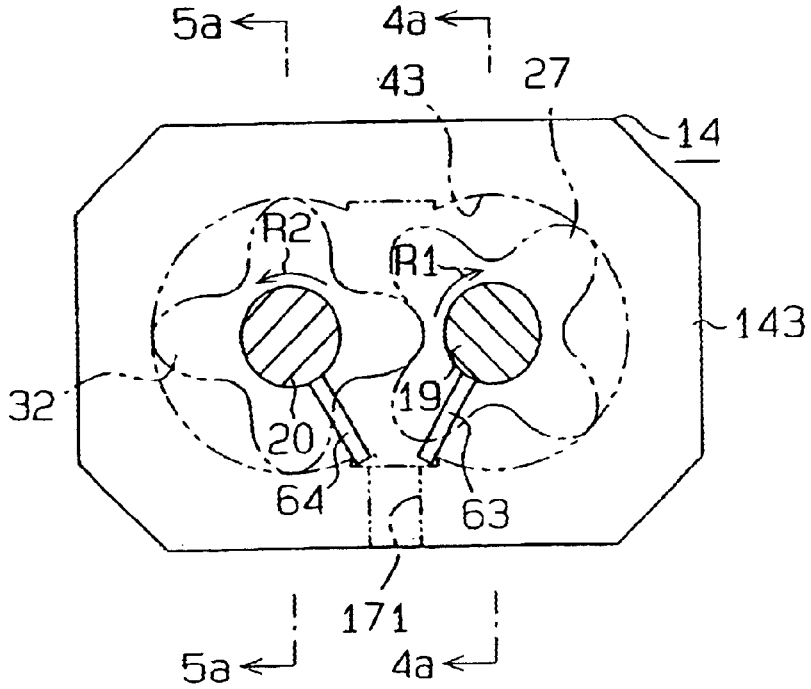

As shown in FIG. 2(*a*), the first rotors 23, 28 define a suction zone 391 and a pressurization zone 392 in the first pump chamber 39. The pressure in the pressurization zone 392 is higher than the pressure in the suction zone 391. Likewise, the second to fourth rotors 24–26, 29–31 define suction zones 391 and pressurization zones 392 in the associated pump chambers 40–42. As shown in FIG. 3(*a*), the fifth rotors 27, 32 define a suction zone 431 and a pressurization zone 432, which are similar to the suction zone 391 and the pressurization zone 392, in the fifth pump chamber 43.

As shown in FIG. 1(*a*), a gear housing member 33 is coupled to the rear housing member 14. A pair of through holes 141, 142 is formed in the rear housing member 14. The rotary shafts 19, 20 extend through the through holes 141, 142 and the first and second bearing receptacles 47, 48, respectively. The rotary shafts 19, 20 thus project into the gear housing member 33 to form projecting portions 193, 203, respectively. Gears 34, 35 are secured to the projecting portions 193, 203, respectively, and are meshed together. An electric motor M is connected to the gear housing member 33. A shaft coupling 44 transmits the drive force of the motor M to the first rotary shaft 19. The motor M rotates the first rotary shaft 19 in the direction indicated by arrow R1 of FIGS. 2(*a*) to 3(*b*). The gears 34, 35 transmit the rotation of the first rotary shaft 19 to the second rotary shaft 20. The second rotary shaft 20 thus rotates in the direction indicated by arrow R2 of FIGS. 2(*a*) to 3(*b*). Accordingly, the first and second rotary shafts 19, 20 rotate in opposite directions. The gears 34, 35 cause the rotary shafts 19, 20 to rotate integrally.

Figure 4C:
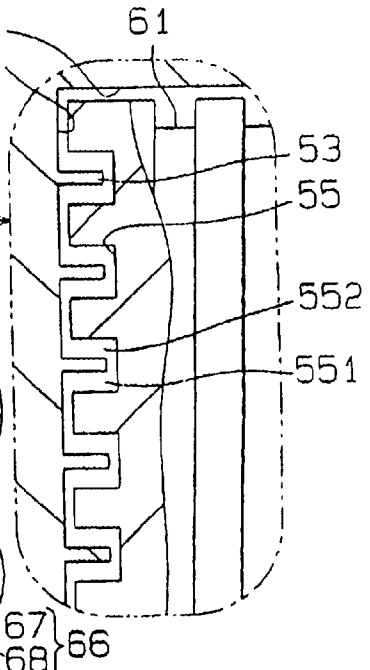
FIG. 4(*a*) is a cross-sectional view taken along line 4*a*—4*a* in FIG. 3(*b*)
Figure 4B:
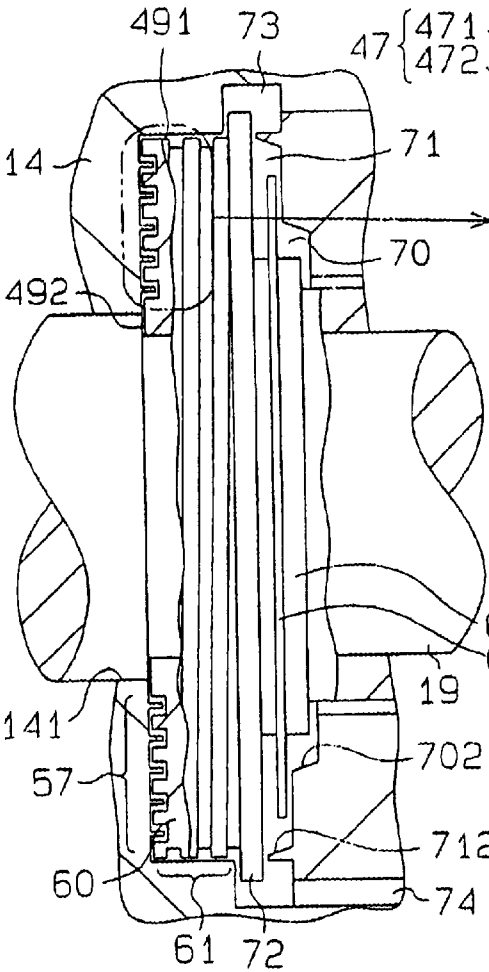
Figure 4A:
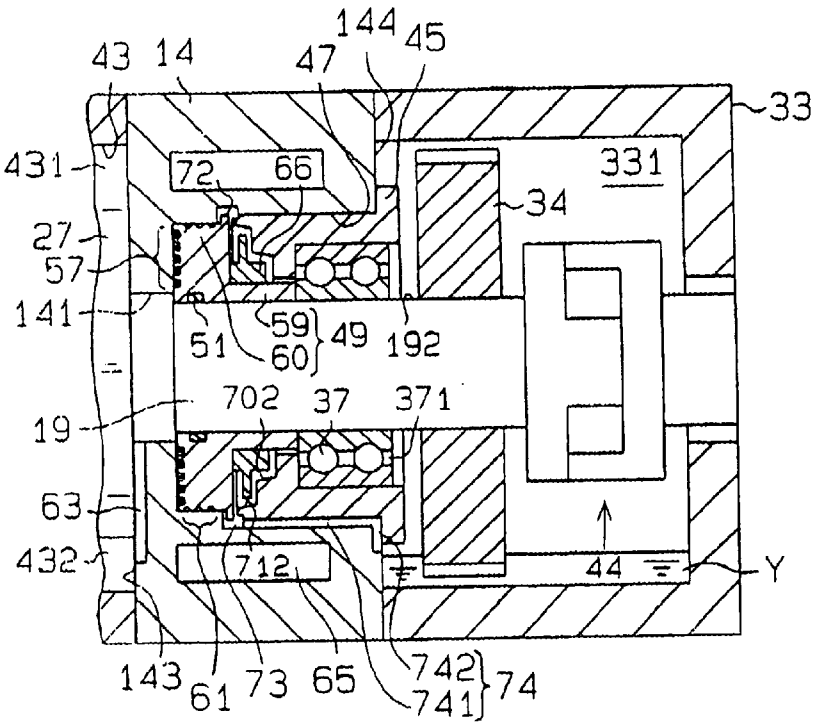

As shown in FIGS. 4(*a*) and 5(*a*), a gear accommodating chamber 331 is defined in the gear housing member 33. The gear accommodating chamber 331 retains lubricant oil Y for lubricating the gears 34, 35. The gears 34, 35 form a gear mechanism, which is accommodated in the gear accommodating chamber 331. The gear accommodating chamber 331 and the bearing receptacles 47, 48 form a sealed oil zone. The gear housing member 33 and the rear housing member 14 form an oil housing, or an oil zone adjacent to the fifth pump chamber 43. The gears 34, 35 rotate to agitate the lubricant oil in the gear accommodating chamber 331. The lubricant oil thus lubricates the radial bearings 37.

As shown in FIG. 2(*b*), a passage 163 is formed in the interior of each chamber defining wall 16. Each chamber defining wall 16 has an inlet 164 and an outlet 165 that are connected to the passage 163. Each adjacent pair of the pump chambers 39–43 are connected to each other by the passage 163 of the associated chamber defining wall 16.

As shown in FIG. 2(*a*), an inlet 181 extends through the block section 18 of the cylinder block 15 and is connected to the first pump chamber 39. As shown in FIG. 3(*a*), an outlet 171 extends through the block section 17 of the cylinder block 15 and is connected to the fifth pump chamber 43. When gas enters the first pump chamber 39 from the inlet 181, rotation of the first rotors 23, 28 sends the gas to the pressurization zone 392. In the pressurization zone 392, the gas is compressed and its pressure is higher than in the suction zone 391. Thereafter, the gas is sent to the suction zone 391 of the second pump chamber 40 through the inlet 164, the passage 163, and the outlet 165 in the corresponding wall defining wall 16. Afterwards, the gas flows from the second pump chamber 40 to the third, fourth, and fifth pump chambers 41, 42, 43 in this order while repeatedly compressed. The volumes of the first to fifth pump chambers 39–43 become gradually smaller in this order. When the gas reaches the suction zone 431 of the fifth pump chamber 43, rotation of the fifth rotors 27, 32 moves the gas to the pressurization zone 432. The gas is then discharged from the outlet 171 to the exterior of the vacuum pump 11. That is, each rotor 23–32 functions as a gas conveying body for conveying gas.

The outlet 171 functions as a discharge passage for discharging gas to the exterior of the vacuum pump 11. The fifth pump chamber 43 is a final-stage pump chamber that is connected to the outlet 171. Among the pressurization zones of the first to fifth pump chambers 39–43, the pressure in the pressurization zone 432 of the fifth pump chamber 43 is the highest, and the pressurization zone 432 functions as a maximum pressurization zone. The outlet 171 is connected to the maximum pressurization zone 432 defined by the fifth rotors 27, 32 in the fifth pump chamber 43.

As shown in FIG. 1(*a*), first and second annular shaft seals 49, 50 are securely fitted about the first and second rotary shafts 19, 20, respectively. The shaft seals 49, 50 are located in the first and second bearing receptacles 47, 48, respectively. A seal ring 51 is located between the inner circumferential surface of the first shaft seal 49 and the circumferential surface 192 of the first rotary shaft 19. Likewise, a seal ring 52 is located between the inner circumferential surface of the second shaft seal 50 and the circumferential surface 202 of the second rotary shaft 20. Each seal ring 51, 52 prevents lubricant oil Y from leaking from the associated receptacles 47, 48 to the fifth pump chamber 43 along the circumferential surface 192, 202 of the associated rotary shaft 19, 20.

As shown in FIG. 4(*a*), the shaft seal 49 includes a small diameter portion 59 and a large diameter portion 60. As shown in FIG. 4(*b*), space exists between the outer circumferential surface 491 of the large diameter portion 60 and the circumferential wall 471, or seal surface, of the first receptacle 47. Also, space exists between the end surface 492 of the first shaft seal 49 and the bottom 472 of the first receptacle 47. As shown in FIG. 5(*a*), the second shaft seal 50 includes a small diameter portion 81 and a large diameter portion 80. As shown in FIG. 5(*b*), space exists between the circumferential surface 501 of the large diameter portion 80 and the circumferential wall 481, or seal surface, of the second receptacle 48. Also, space exists between the end surface 502 of the second shaft seal 50 and the bottom 482 of the second receptacle 48.

Annular projections 53 coaxially project from the bottom 472 of the first receptacle 47. In the same manner, annular projections 54 coaxially project from the bottom 482 of the second receptacle 48. Annular grooves 55 are coaxially formed in the end surface 492 of the first shaft seal 49, which faces the bottom 472 of the first receptacle 47. In the same manner, annular grooves 56 are coaxially formed in the end surface 502 of the second shaft seal 50, which faces the bottom 482 of the second receptacle 48. Each annular projection 53, 54 projects in the associated groove 55, 56. The distal end of the projection 53, 54 is located close to the bottom of the groove 55, 56. Each projection 53 divides the interior of the associated groove 55 of the first shaft seal 49 to a pair of labyrinth chambers 551, 552. Each projection 54 divides the interior of the associated groove 56 of the second shaft seal 50 to a pair of labyrinth chambers 561, 562. The projections 53 and the grooves 55 form a first labyrinth seal 57 corresponding to the first rotary shaft 19. The projections 54 and the grooves 56 form a second labyrinth seal 58 corresponding to the second rotary shaft 20. The front surfaces 492, 502 of the shaft seals 49, 50 function as sealing surface of the shaft seals 49, 50. The bottoms 472, 482 of the bearing receptacles 47, 48 function as sealing surface of the rear housing member 14. In this embodiment, the end surface 492 and the bottom 472 are formed along a plane perpendicular to the axis 191 of the first rotary shaft 19. Likewise, the end surface 502 and the bottom 482 are formed along a plane perpendicular to the axis 201 of the rotary shaft 20. In other words, the end surface 492 and the bottom 472 are seal forming surfaces that extend in a radial direction of the first shaft seal 49. Likewise, the end surface 502 and the bottom 482 are seal forming surfaces that extend in a radial direction of the second shaft seal 50.

As shown in FIGS. 4(*b*) and 7, a first helical groove 61 is formed in the outer circumferential surface 491 of the large diameter portion 60 of the first shaft seal 49. As shown in FIGS. 5(*b*) and 8, a second helical groove 62 is formed in the outer circumferential surface 501 of the large diameter portion 60 of the second shaft seal 50. Along the rotational direction R1 of the first rotary shaft 19, the first helical groove 61 forms a path that leads from a side corresponding to the gear accommodating chamber 331 toward the fifth pump chamber 43. Along the rotational direction R2 of the second rotary shaft 20, the second helical groove 62 forms a path that leads from a side corresponding to the gear accommodating chamber 331 toward the fifth pump chamber 43. Therefore, each helical groove 61, 62 exerts a pumping effect and conveys fluid from a side corresponding to the fifth pump chamber 43 toward the gear accommodating chamber 331 when the rotary shafts 19, 20 rotate. That is, each helical groove 61, 62 forms pumping means that urges the lubricant oil between the outer circumferential surface 491, 501 of the associated shaft seal 49, 50 and the circumferential wall 471, 481 of the associated receptacles 47, 48 to move from a side corresponding to the fifth pump chamber 43 toward the oil zone. The circumferential walls 471, 481 of the bearing receptacles 47, 48 function as sealing surfaces. The outer circumferential surfaces 491, 501 face the sealing surfaces.

As shown in FIG. 3(*b*), first and second discharge pressure introducing channels 63, 64 are formed in a chamber defining wall 143 of the rear housing member 14. The chamber defining wall 143 defines the fifth pump chamber 43, which is at the final stage of compression. As shown in FIG. 4(*a*), the first discharge pressure introducing channel 63 is connected to the maximum pressurization zone 432, the volume of which is varied by rotation of the fifth rotors 27, 32. The first discharge pressure introducing channel 63 is also connected to the through hole 141. As shown in FIG. 5(*a*), the second discharge pressure introducing channel 64 is connected to the maximum pressurization zone 432 and the through hole 142.

As shown in FIGS. 1(*a*), 4(*a*), and 5(*a*), a cooling loop chamber 65 is formed in the rear housing member 14. The loop chamber 65 surrounds the shaft seals 49, 50. Coolant circulates in the loop chamber 65. Coolant in the loop chamber 65 cools the lubricant oil Y in the bearing receptacles 47, 48. This prevents the lubricant oil Y from evaporating.

As shown in FIGS. 1(*b*), 6(*a*) and 6(*b*), an annular leak prevention ring 66 is fitted about the small diameter portion 59 of the first shaft seal 49 to block flow of oil. The leak prevention ring 66 includes a first stopper 67 having a smaller diameter and a second stopper 68 having a larger diameter. A front end portion of the bearing holder 45 has an annular projection 69 projecting inward and defines an annular first oil chamber 70 and an annular second oil chamber 71 about the leak prevention ring 66. The first oil chamber 70 surrounds the first stopper 67, and the second oil chamber 71 surrounds the second stopper 68.

A circumferential surface 671 of the first stopper 67 is located in the first oil chamber 70, and a circumferential surface 681 of the second stopper 68 is located in the second oil chamber 71. The circumferential surface 671 faces a circumferential wall surface 702, which defines the first oil chamber 70. The circumferential surface 681 of the second stopper 68 faces a circumferential wall surface 712, which defines the second oil chamber 71.

Figure 6B:
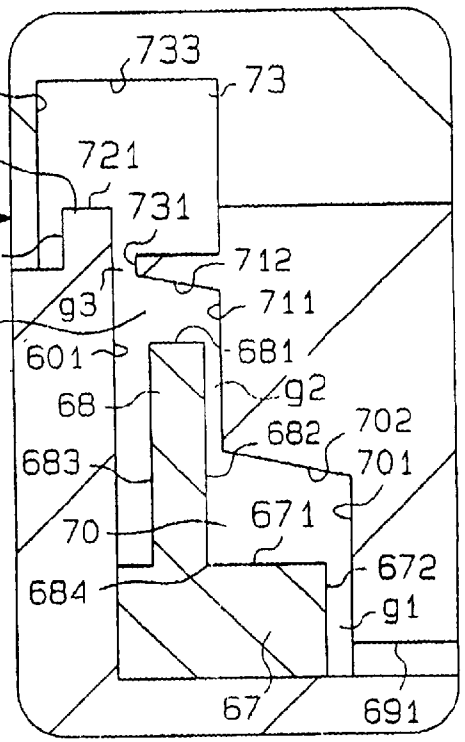
FIG. 6(*a*) is an enlarged cross-sectional view of the pump shown in FIG. 1(*a*)
Figure 6A:
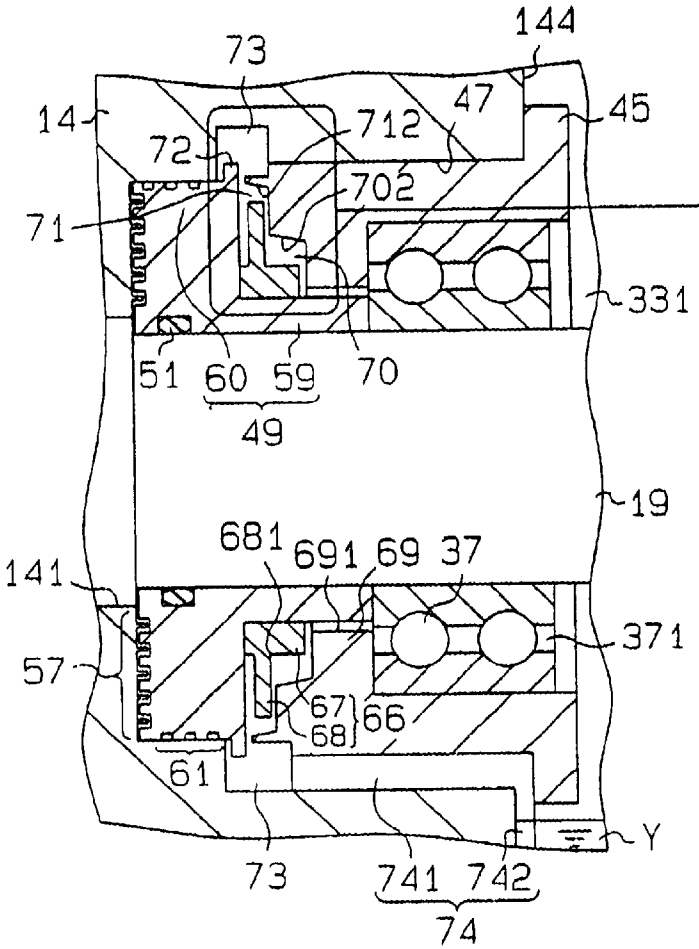
Figure 7:
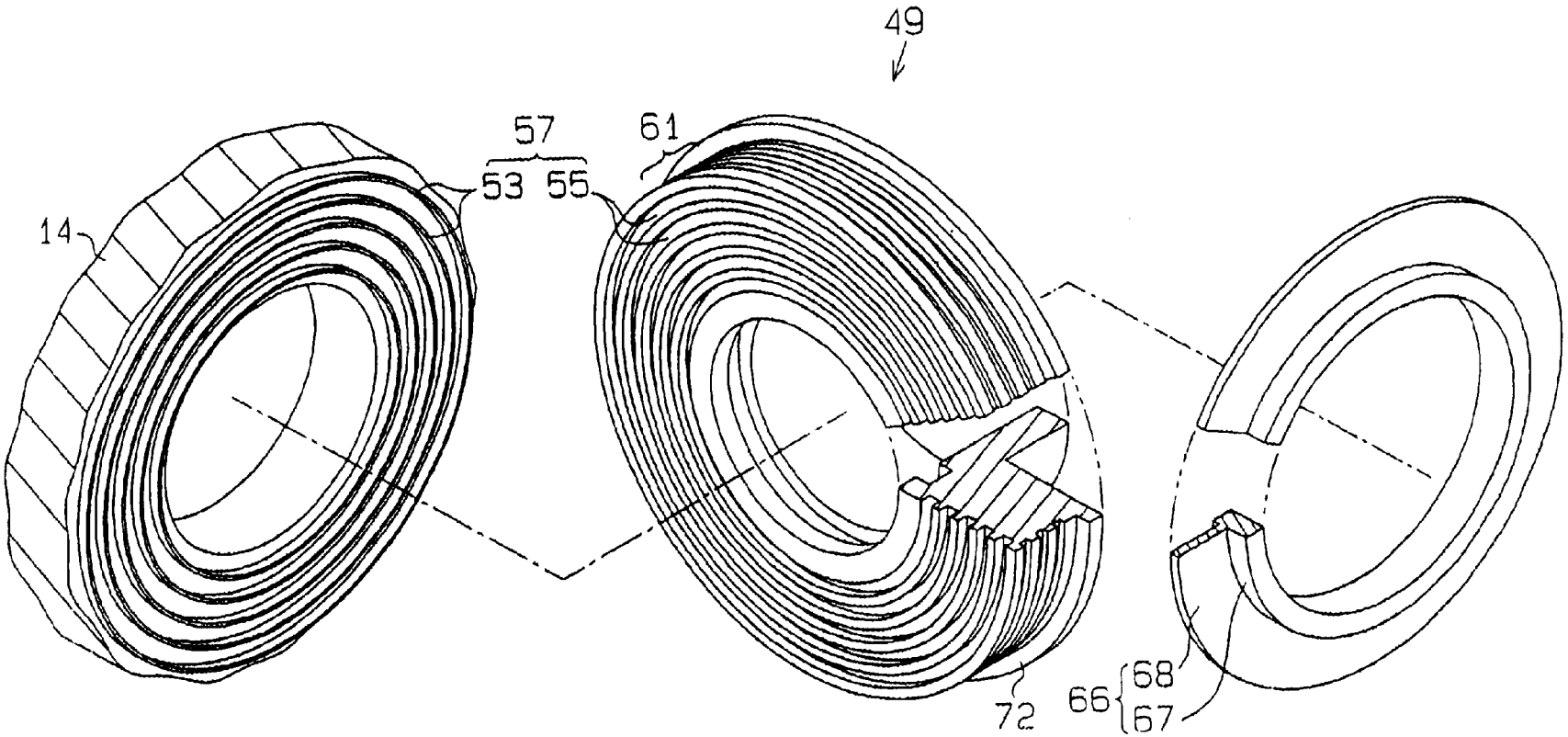
FIG. 7 is an exploded perspective view illustrating part of the rear housing member, the first shaft seal, and a leak prevention ring of the pump shown in FIG. 1(*a*)
Figure 8:
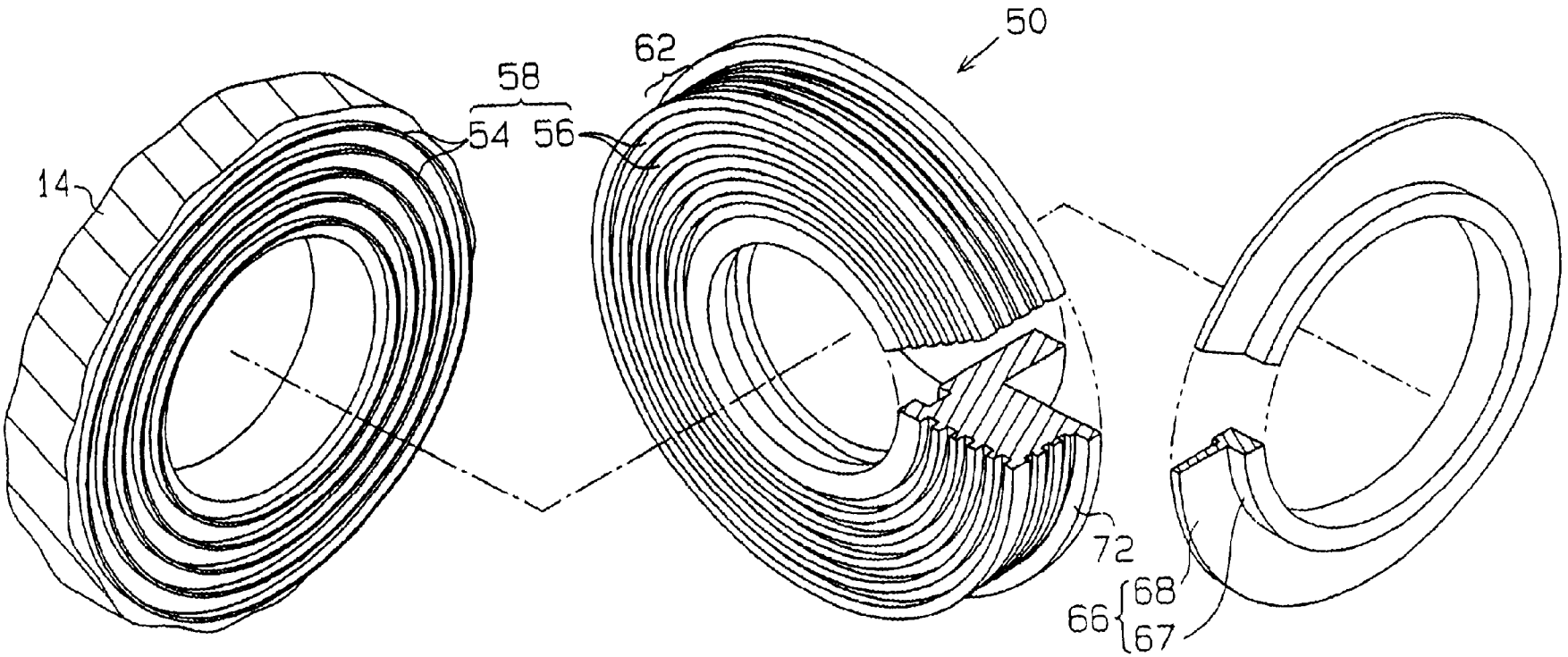
FIG. 8 is an exploded perspective view illustrating part of the rear housing member, the second shaft seal, and a leak prevention ring of the pump shown in FIG. 1(*a*)

The circumferential wall surfaces 702, 712 are tapered. The radial dimension of the circumferential wall surface 702 decreases, or approaches the axis 191 of the rotary shaft 19, from the side corresponding to the fifth pump chamber 43 toward the side corresponding to the gear accommodating chamber 331. The rear surface 672 of the first stopper 67 faces an annular end surface 701, which defines the first oil chamber 70. The rear surface 682, which is located at the right side as viewed in FIG. 6, of the second stopper 68 faces an annular end surface 711, which defines the second oil chamber 71. The front surface 683 of the second stopper 68 faces and is widely separated from the rear surface 601 of the large diameter portion 60 of the first shaft seal 49.

The third stopper 72 is integrally formed with the large diameter portion 60 of the first shaft seal 49. A third annular oil chamber 73 is defined in the first receptacle 47 to surround the third stopper 72. A circumferential surface 721 of the third stopper 72 is defined on a portion that projects into the third oil chamber 73. Also, the circumferential surface 721 of the third stopper 72 faces a circumferential wall surface 733 defining the third oil chamber 73. The rear surface 601 of the third stopper 72 faces and is located in the vicinity of an end surface 731 defining the third oil chamber 73. The front surface 722 of the third stopper 72 faces and is located in the vicinity of a wall 732 defining the third oil chamber 73.

A drainage channel 74 is defined in the lowest portion of the first receptacle 47 and the end 144 of the rear housing 14 to return the lubricant oil Y to the gear accommodation chamber 331. The drainage channel 74 has an axial portion 741, which is formed in the lowest part of the receptacle 47, and a radial portion 742, which is formed in the end 144. The axial portion 741 is communicated with the third oil chamber 73, and the radial portion 742 is communicated with the gear accommodation chamber 331. That is, the third oil chamber 73 is connected to the gear accommodating chamber 331 by the drainage channel 74.

An annular leak prevention ring 66 is fitted about the small diameter portion 59 of the second shaft seal 50 to block flow of oil. A third stopper 72 is formed on the large diameter portion 80 of the second shaft seal 50. The first and second oil chambers 70, 71 are defined in the bearing holder 45, and the third oil chamber 73 is defined in the second receptacle 48. A drainage channel 74 is formed in the lowest part of the receptacle 48. Part of the third oil chamber 73 corresponding to the second shaft seal 50 is connected to the gear accommodating chamber 331 by the drainage channel 74 corresponding to the second shaft seal 50.

The lubricant oil Y stored in the gear accommodating chamber 331 lubricates the gears 34, 35 and the radial bearings 37. After lubricating the radial bearings 37, the oil Y enters a through hole 691 formed in the projection 69 of each bearing holder 45 through a space 371 in each radial bearing 37. Then, the oil Y moves toward the corresponding first oil chamber 70 via a space g1 between the rear surface 672 of the corresponding first stopper 67 and the end surface 701 of the corresponding first oil chamber 70. At this time, some of the oil Y that reaches the rear surface 672 of the first stopper 67 is thrown to the circumferential wall surface 702 or the end surface 701 of the first oil chamber 70 by the centrifugal force generated by rotation of the first stopper 67. At least part of the oil Y thrown to the circumferential wall surface 702 or the end surface 701 remains on the circumferential wall surface 702 or the end surface 701. Then, the remaining oil Y falls along the surfaces 701, 702 by the self weight and reaches the lowest area of the first oil chamber 70. After reaching the lowest area of the first oil chamber 70, the oil Y moves to the lowest area of the second oil chamber 71.

After entering the first oil chamber 70, the lubricant oil Y moves toward the second oil chamber 71 through a space g2 between the rear surface 682 of the second stopper 68 and the end surface 711 of the second oil chamber 71. At this time, the lubricant oil Y on the circumferential surface 671 is thrown to the circumferential wall surface 702 by the centrifugal force generated by rotation of the first stopper 67. At this time, the lubricant oil Y on the rear surface 682 is thrown to the circumferential wall surface 712 or the end surface 711 of the second oil chamber 71 by the centrifugal force generated by rotation of the second stopper 68. At least part of the lubricant oil Y thrown to the circumferential wall surfaces 702, 712 or the end surface 711 remains on the surfaces 702, 712 or the end surface 711. The remaining oil Y falls along the surfaces 702, 712 or along the end surfaces 701, 711 by the self weight and reaches the lowest part of the second oil chamber 71.

After reaching the lowest part of the second oil chamber 71, the lubricant oil Y moves to the lowest part of the third oil chamber 73. After entering the second oil chamber 71, the lubricant oil Y moves toward the third oil chamber 73 through a space g3 between the rear surface 601 of the third stopper 72 and the end surface 731 of the third chamber 73. At this time, the lubricant oil Y on the circumferential surface 681 is thrown to the circumferential wall surface 712 by the centrifugal force generated by rotation of the second stopper 68. At this time, the lubricant oil Y on the rear surface 601 is thrown to the circumferential wall surface 733 or the end surface 731 of the third oil chamber 73 by the centrifugal force generated by rotation of the third stopper 72. At least part of the lubricant oil Y thrown to the circumferential wall surface 733 or the end surface 731 remains on the wall 733 or the surface 731. The remaining oil Y falls along the wall 733 and the surface 731 by the self weight and reaches the lowest part of the third oil chamber 73.

After reaching the lowest part of the third oil chamber 73, the lubricant oil Y is returned to the gear accommodating chamber 331 by the corresponding drainage channel 74.

The first embodiment has the following advantages.

(1-1) While the vacuum pump is operating, the pressures in the five pump chambers 39, 40, 41, 42, 43 are lower than the pressure in the gear accommodating chamber 331, which is a zone exposed to the atmospheric pressure. Thus, lubricant oil Y moves along the surface of the leak prevention rings 66 and the surface of the shaft seals 49, 50 toward the fifth pump chamber 43. Above the axes 191, 201 of the rotary shafts 19, 20, lubricant oil Y flows downward along the front surfaces 492, 502 of the shaft seals 49, 50 from the circumferential surface 491 of the shaft seal 49, 50 to the fifth pump chamber 43. Below the axes 191, 201 of the rotary shafts 19, 20, lubricant oil Y flows upward along the front surfaces 492, 502 of the shaft seals 49, 50 from the circumferential surface 491 of the shaft seal 49, 50 to the fifth pump chamber 43. Therefore, the lubricant oil Y is more likely to enter the fifth chamber 43 along the shaft seals 49, 50 above the axes 191, 201.

At least part of the lubricant oil Y thrown to the circumferential wall surfaces 702, 712 remains on the surfaces 702, 712. Above the rotary shafts 19, 20, the surfaces 702, 712 are tapered downward from the side corresponding to the fifth pump chambers 43 toward the side corresponding to the gear accommodating chamber 331. That is, the lubricant oil Y on the part of the surfaces 702, 712 above the rotary shafts 19, 20 flows downward in relation with the rotary shafts 19, 20 while flowing away from the fifth pump chamber 43. Since the surfaces 702, 712 permit the lubricant oil Y to flow downward in relation to the rotary shafts 19, 20 and away from the fifth pump chambers 43, the lubricant oil Y is effectively prevented from entering the fifth pump chambers 43.

(1-2) The lubricant oil Y on part of the circumferential wall surfaces 702, 712 above the rotary shafts 19, 20 flows downward along the end surfaces 701, 711, which are perpendicular to the axes 191, 201 of the rotary shafts 19, 20. Thereafter, the lubricant oil Y smoothly flows downward along the end surfaces 701, 711 to the portion below the rotary shafts 19, 20. The end surfaces 701, 711, which are connected to and perpendicular to the circumferential wall surfaces 702, 712, permits the lubricant oil Y on the area above the rotary shafts 19, 20 to smoothly flow downward to the area below the rotary shafts 19, 20.

(1-3) In the Roots pump 11 having the laterally arranged rotary shafts 19, 20, the lubricant oil Y on the walls of the oil chambers 70, 71, 73 falls to the third oil chamber 73 by the self weight. In other words, the lubricant oil Y on the walls of the oil chambers 70, 71, 73 is collected to the lowest part of the third oil chamber 73 along the walls. Therefore, the oil on the walls of the oil chambers 70, 71, 73 reliably flows to the gear accommodating chamber 331 via the drainage channel 74 connected to the lowest part of the third oil chamber 73.

(1-4) The first oil chamber 70 and the second oil chamber 71 are defined by the front end portion 69 of the bearing holder 45, which supports the radial bearing 37. Since the oil chambers 70, 71 are formed in the bearing holders 45 supporting the radial bearings 37, the sealing property of the oil chambers 70, 71 are improved.

(1-5) The diameters of the end surfaces 492, 502 of the shaft seals 49, 50 fitted about the first and second rotary shafts 19, 20 are greater than the diameters of the circumferential surfaces 192, 202 of the rotary shafts 19, 20. Therefore, the diameter of each of the first and second labyrinth seals 57, 58 located between the end surface 492, 502 of each shaft seal 49, 50 and the bottom surface 472, 482 of the corresponding bearing receptacles 47, 48 is greater than the diameter of the labyrinth seal (not shown) located between the circumferential surface 192, 202 of each rotary shaft 19, 20 and the through hole 141, 142. As the diameter of each labyrinth seal 57, 58 is increased, the volume of each labyrinth chamber 551, 552, 561, 562 for preventing pressure fluctuations from spreading is increased. This structure improves the sealing performance of each labyrinth seal 57, 58. That is, the space between the end surface 492, 502 of each shaft seal 49, 50 and the bottom surface 472, 482 of the associated bearing receptacles 47, 48 is suitable for accommodating the labyrinth seal 57, 58 for improving the sealing performance by increasing the volume of each labyrinth chamber 551, 552, 561, 562.

(1-6) As the space between each bearing receptacle 47, 48 and the corresponding shaft seal 49, 50 is decreased, it is harder for the lubricant oil Y to enter the space between the bearing receptacle 47, 48 and the shaft seal 49, 50. The bottom surface 472, 482 of each receptacle 47, 48, which has the circumferential wall 471, 481, and the end surface 492, 502 of the corresponding shaft seal 49, 50 are easily formed to be close to each other. Therefore, the space between the end of each annular projection 53, 54 and the bottom of the corresponding annular groove 55, 56 and the space between the bottom surface 472, 482 of each receptacle 47, 48 and the end surface 492, 502 of the corresponding shaft seal 49, 50 can be easily decreased. As the spaces are decreased, the sealing performance of the labyrinth seals 57, 58 is improved. That is, the bottom surface 472, 482 of each receptacle 47, 48 is suitable for accommodating the labyrinth seal 57, 58.

(1-7) The labyrinth seals 57, 58 sufficiently blocks flow of gas. When the Roots pump 11 is started, the pressures in the five pump chambers 39–43 are higher than the atmospheric pressure. However, each labyrinth seal 57, 58 prevents gas from leaking from the fifth pump chamber 43 to the gear accommodating chamber 331 along the surface of the associated shaft seal 49, 50. That is, the labyrinth seals 57, 58 stop both oil leak and gas leak and are optimal non-contact type seals.

(1-8) Although the sealing performance of a non-contact type seal does not deteriorate over time unlike a contact type seal such as a lip seal, the sealing performance of a non-contact type seal is inferior to the sealing performance of a contact type seal. However, in the above described embodiment, the first, second and third stoppers 67, 68, 72 compensate for the sealing performance.

(1-9) As the first rotary shaft 19 rotates, the oil Y in the first helical groove 61 is guided from the side corresponding to the fifth pump chamber 43 to the side corresponding to the gear accommodating chamber 331. As the second rotary shaft 20 rotates, the oil Y in the second helical groove 62 is guided from the side corresponding to the fifth pump chamber 43 to the side corresponding to the gear accommodating chamber 331. That is, the shaft seals 49, 50, which have the first and second helical grooves 61, 62 functioning as pumping means, positively prevent leakage of the oil Y.

(1-10) The outer circumferential surfaces 491, 501, on which the helical grooves 61, 62 are formed, coincide with the outer surface of the large diameter portions 60, 80 of the first and second shaft seals 49, 50. At these parts, the velocity is maximum when the shaft seals 49, 50 rotate. Gas located between the outer circumferential surface 491, 501 of each shaft seal 49, 50 and the circumferential wall 471, 481 of the corresponding bearing receptacles 47, 48 is effectively urged from the side corresponding to the fifth pump chamber 43 to the side corresponding to the gear accommodating chamber 331 through the first and second helical grooves 61, 62, which are moving at a high speed. The lubricant oil Y located between the outer circumferential surface 491, 501 of each shaft seal 49, 50 and the circumferential wall 471, 481 of the corresponding bearing receptacles 47, 48 flows with gas that is effectively urged from the side corresponding to the fifth pump chamber 43 to the side corresponding to the gear accommodating chamber 331. The helical grooves 61, 62 formed in the outer circumferential surface 491, 501 of the shaft seals 49, 50 effectively prevent the oil Y from leaking into the fifth pump chamber 43 from the bearing receptacles 47, 48 via the spaces between the outer circumferential surfaces 491, 501 and the circumferential walls 471, 481.

(1-11) A small space is created between the circumferential surface 192 of the first rotary shaft 19 and the through hole 141. Also, a small space is created between each rotor 27, 32 and the chamber defining wall 143 of the rear housing member 14. Therefore, the labyrinth seal 57 is exposed to the pressure in the fifth pump chamber 43 introduced through the narrow spaces. Likewise, a small space is created between the circumferential surface 202 of the second rotary shaft 20 and the through hole 142. Therefore, the second labyrinth seal 58 is exposed to the pressure in the fifth pump chamber 43 through the space. If there are no channels 63, 64, the labyrinth seals 57, 58 are equally exposed to the pressure in the suction zone 431 and to the pressure in the maximum pressurization zone 432.

The first and second discharge pressure introducing channels 63, 64 expose the labyrinth seals 57, 58 to the pressure in the maximum pressurization zone 432. That is, the labyrinth seals 57, 58 are influenced more by the pressure in the maximum pressurization zone 432 via the introducing channels 63, 64 than by the pressure in the suction zone 431. Thus, compared to a case where no discharge pressure introducing channels 63, 64 are formed, the labyrinth seals 57, 58 of the first embodiment receive higher pressure. As a result, compared to a case where no discharge pressure introducing channels 63, 64 are formed, the difference between the pressures acting on the front surface and the rear surface of the labyrinth seals 57, 58 is significantly small. In other words, the discharge pressure introducing channels 63, 64 significantly improve the oil leakage preventing performance of the labyrinth seals 57, 58.

(1-13) Since the Roots pump 11 is a dry type, no lubricant oil Y is used in the five pump chambers 39, 40, 41, 42, 43. Therefore, the present invention is suitable for the Roots pump 11.

Figure 10:
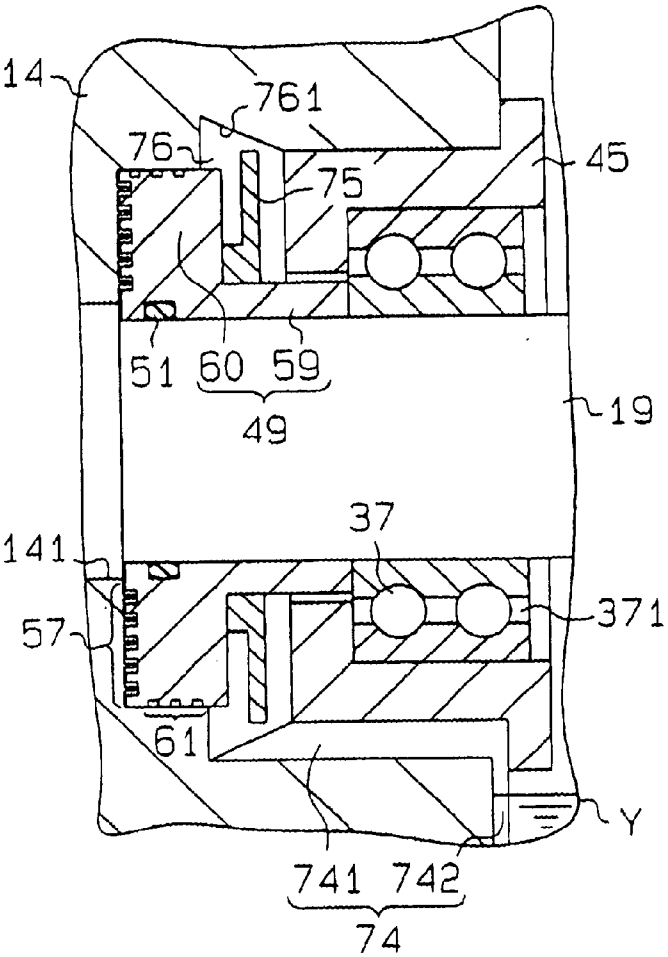
FIG. 10 is an enlarged cross-sectional view illustrating a third embodiment of the present invention.
Figure 9:
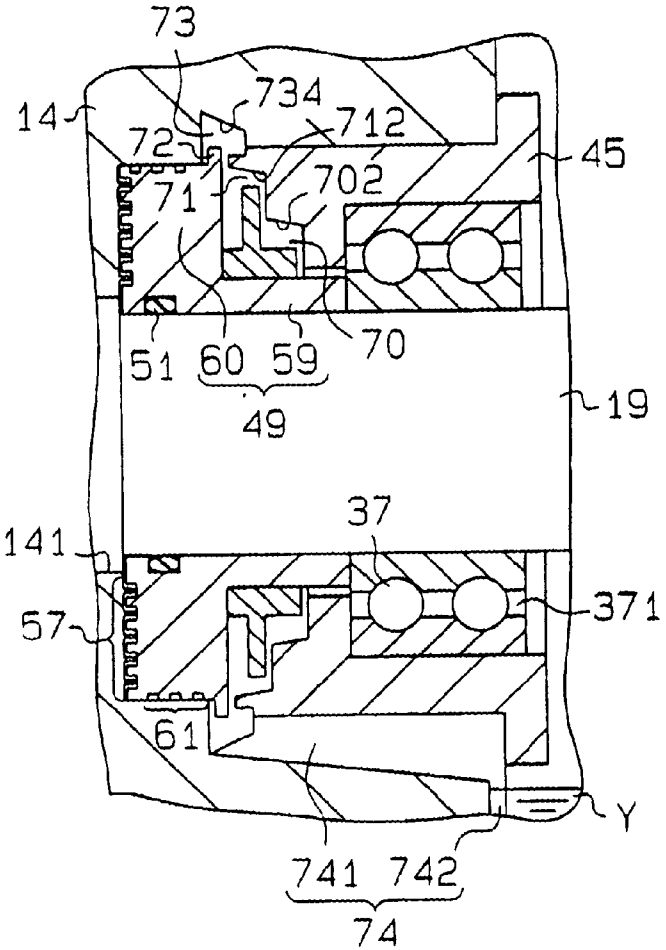
FIG. 9 is an enlarged cross-sectional view illustrating a second embodiment of the present invention.
Figure 11:
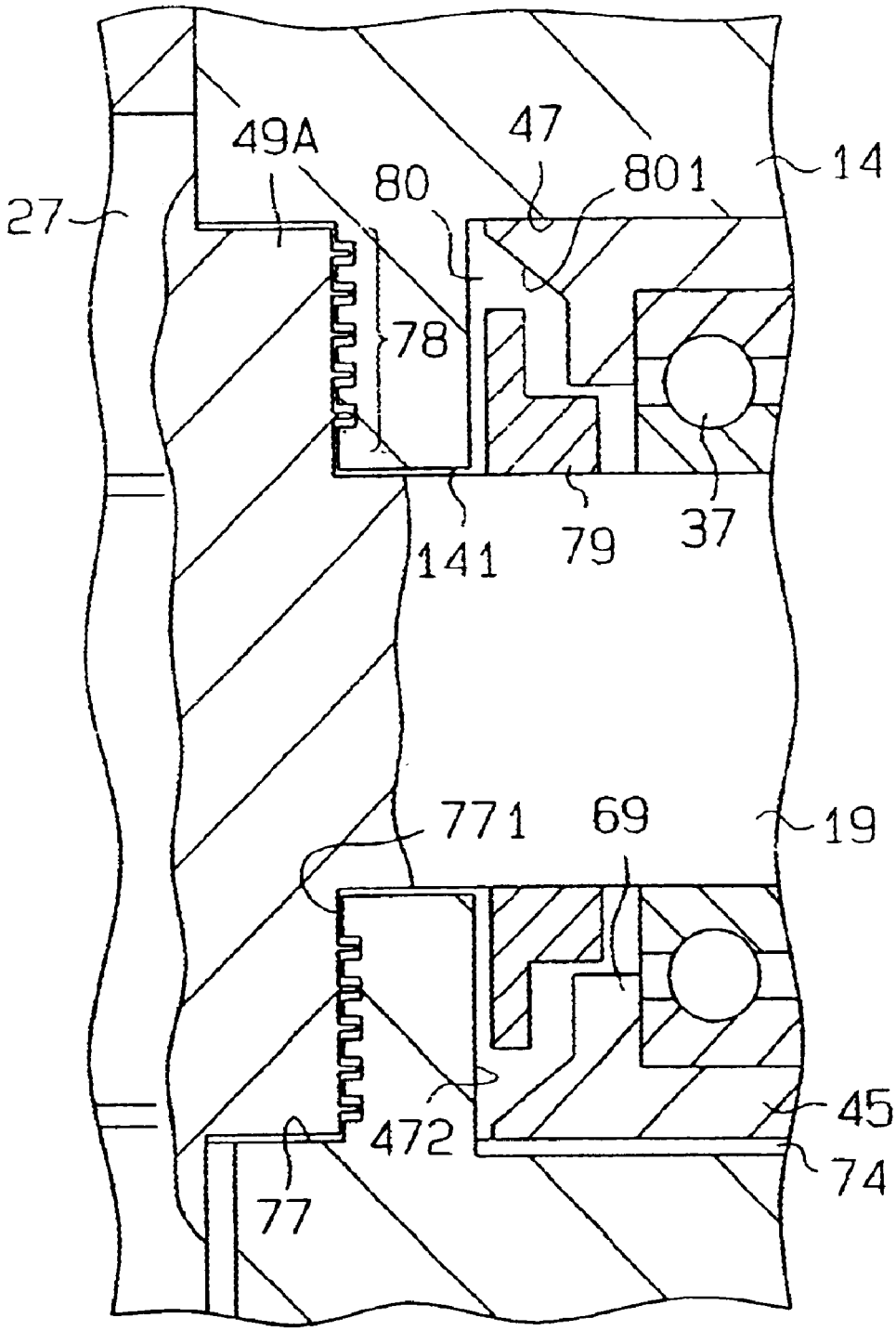
FIG. 11 is an enlarged cross-sectional view illustrating a fourth embodiment of the present invention.

The present invention may be embodied in other forms. For example, the present invention may be embodied as second to fourth embodiments, which are illustrated in FIGS. 9 to 11, respectively. In the second to fourth embodiments, like or the same reference numerals are given to those components that are like or the same as the corresponding components of the first embodiment. Since the first and second rotary shafts 19, 20 have the same structure, only the first rotary shaft 19 will be described in the second to fourth embodiments.

In the second embodiment shown in FIG. 9, the third oil chamber 73 has a tapered circumferential wall surface 734. The surface 734 functions in the same manner as the surfaces 702, 712 of the first embodiment. The drainage channel 74 is inclined downward toward the gear accommodating chamber 331.

In the third embodiment shown in FIG. 10, an oil leakage prevention ring 75 is located in an oil chamber 76. The oil chamber 76 has a tapered circumferential wall surface 761. The surface 761 functions in the same manner as the surfaces 702, 712 of the first embodiment.

In the fourth embodiment shown in FIG. 11, a shaft seal 49A is integrally formed with the end surfaces of the rotary shaft 19 and the rotor 27. The shaft seal 49A is located in a receptacle 77 formed in the front wall of the rear housing member 14, which faces the rotor housing member 12. A labyrinth seal 78 is located between the rear surface of the first shaft seal 49A and the bottom 771 of the receptacle 77.

An oil leak prevention ring 79 is fitted about the rotary shaft 19. An annular oil chamber 80 is defined between the bottom 472 of the receptacle 47 and the projection 69 of the bearing holder 45. The oil leak prevention ring 79 projects into the oil chamber 80.

The oil chamber 80 has a tapered circumferential wall surface 801. The surface 801 functions in the same manner as the surfaces 702, 712 of the first embodiment.

It should be apparent to those skilled in the art that the present invention may be embodied in many other specific forms without departing from the spirit or scope of the invention. Particularly, it should be understood that the invention may be embodied in the following forms.

(1) In the first embodiment, each shaft seal 49, 50 may be integrally formed with the corresponding leak prevention ring 66.

(2) In the first embodiment, part of each circumferential wall surface 702, 712 that is located below the corresponding rotary shaft 19, 20 need not be tapered.

(3) The present invention may be applied to other types of vacuum pumps than Roots types.

Therefore, the present examples and embodiments are to be considered as illustrative and not restrictive and the invention is not to be limited to the details given herein, but may be modified within the scope and equivalence of the appended claims.

What is claimed is:

1. A vacuum pump that draws gas by operating a gas conveying body in a pump chamber through rotation of a horizontal rotary shaft, the vacuum pump comprising:

an oil housing member, wherein the oil housing member defines an oil zone adjacent to the pump chamber, and the rotary shaft has a projecting portion that projects from the pump chamber into the oil zone through the oil housing member;

a stopper having a circumferential surface, wherein the stopper is located on the rotary shaft to rotate integrally with the rotary shaft and prevents oil from entering the pump chamber; and a circumferential wall surface, the center of curvature of which coinciding with that of the rotary shaft, wherein the circumferential wall surface surrounds at least a part of the circumferential surface of the stopper that is above the rotary shaft, and wherein the circumferential wall surface that is above the rotary shaft is inclined downward from the pump chamber to the oil zone such that the distance between the circumferential wall surface and the axis of the rotary shaft decreases toward the oil zone.

2. The pump according to claim 1, wherein the oil zone accommodates a bearing, which rotatably supports the rotary shaft.

3. The pump according to claim 1, further comprising:

an annular shaft seal, which is located about the projecting portion to rotate integrally with the rotary shaft, wherein the shaft seal is located closer to the pump chamber than the stopper is and has a first seal forming surface that extends in a radial direction of the shaft seal;

a second seal forming surface formed on the oil housing member, wherein the second seal forming surface faces the first seal forming surface and is substantially parallel with the first seal forming surface; and a non-contact type seal located between the first and second seal forming surfaces.

4. The pump according to claim 1, further comprising:

a seal surface located on the oil housing;

an annular shaft seal, which is located about the projecting portion to rotate integrally with the rotary shaft, wherein the shaft seal is located closer to the pump chamber than the stopper is, wherein the shaft seal includes pumping means located on a surface of the shaft seal that faces the seal surface, wherein the pumping means guides oil between a surface of the shaft seal and the seal surface from the side closer to the pump chamber toward the side closer to the oil zone.

5. The pump according to claim 1, further comprising an annular end surface, which is substantially perpendicular to the axis of the rotary shaft and surrounds the rotary shaft, wherein the circumferential wall surface is connected to the annular end surface.

6. The pump according to claim 5, further comprising:

an annular oil chamber surrounding the stopper, wherein the center of the oil chamber coincides with the axis of the rotary shaft, wherein the circumferential wall surface and the annular end surface define a part of the oil chamber; and a drainage channel, which connects the oil chamber to the oil zone to conduct oil to the oil zone.

7. The pump according to claim 6, wherein the drainage channel is connected to the lowest part of the oil chamber.

8. The pump according to claim 7, wherein the drainage channel is substantially horizontal or is inclined downward toward the oil zone.

9. The vacuum pump according to claim 1, wherein the rotary shaft is one of a plurality of parallel rotary shafts, wherein the rotary shafts are connected to one another by a gear mechanism such that the rotary shafts rotate synchronously, and wherein the gear mechanism is located in the oil zone.

10. The vacuum pump according to claim 9, wherein a plurality of rotors are located about each rotary shaft such that each rotor functions as the gas conveying body, and wherein the rotors of one rotary shaft are engaged with the rotors of another rotary shaft.

11. The vacuum pump according to claim 1, wherein the rotary shaft is one of a plurality of parallel rotary shafts, wherein the rotary shafts are connected to one another by a gear mechanism such that the rotary shafts rotate synchronously, and wherein the gear mechanism is located in the oil zone.

12. The vacuum pump according to claim 11, wherein a plurality of rotors are located about each rotary shaft such that each rotor functions as the gas conveying body, and wherein the rotors of one rotary shaft are engaged with the rotors of another rotary shaft.

13. A vacuum pump that draws gas by operating a gas conveying body in a pump chamber through rotation of a horizontal rotary shaft, the vacuum pump comprising:

an oil housing member, wherein the oil housing member defines an oil zone adjacent to the pump chamber, and the rotary shaft has a projecting portion that projects from the pump chamber into the oil zone through the oil housing member;

a stopper having a circumferential surface, wherein the stopper is located on the rotary shaft to rotate integrally with the rotary shaft and prevents oil from entering the pump chamber; and an annular circumferential wall surface for surrounding the rotary shaft, and wherein the circumferential wall surface that is above the rotary shaft is above the stopper and is inclined downward from the pump chamber to the oil zone such that the distance between the circumferential wall surface and the axis of the rotary shaft decreases toward the oil zone.

14. The pump according to claim 13, wherein the oil zone accommodates a bearing, which rotatably supports the rotary shaft.

15. The pump according to claim 13, further comprising an annular end surface, which is substantially perpendicular to the axis of the rotary shaft and surrounds the rotary shaft, wherein the circumferential wall surface is connected to the annular end surface.

16. The pump according to claim 15, further comprising:

an annular oil chamber surrounding the stopper, wherein the center of the oil chamber coincides with the axis of the rotary shaft, wherein the circumferential wall surface and the annular end surface define a part of the oil chamber; and a drainage channel, which connects the oil chamber to the oil zone to conduct oil to the oil zone.

17. The pump according to claim 16, wherein the drainage channel is connected to the lowest part of the oil chamber.

18. The pump according to claim 17, the drainage channel is substantially horizontal or is inclined downward toward the oil zone.

* * * * *

UNITED STATES PATENT AND TRADEMARK OFFICE

CERTIFICATE OF CORRECTION

PATENT NO. : 6,688,863 B2
DATED : February 10, 2004
INVENTOR(S) : Hoshino et al.

It is certified that error appears in the above-identified patent and that said Letters Patent is hereby corrected as shown below:

Column 14,
Line 28, please delete "claim 17, the drainage" and insert therefore -- claim 17, wherein the drainage --.

Signed and Sealed this

Eleventh Day of May, 2004

JON W. DUDAS
*Acting Director of the United States Patent and Trademark Office*